US009069283B2

(12) United States Patent
Hatanaka

(10) Patent No.: US 9,069,283 B2
(45) Date of Patent: Jun. 30, 2015

(54) IMAGE FORMATION UNIT AND IMAGE FORMATION APPARATUS

(71) Applicant: Oki Data Corporation, Tokyo (JP)

(72) Inventor: Shun Hatanaka, Tokyo (JP)

(73) Assignee: Oki Data Corporation, Tokyo (JP)

( * ) Notice: Subject to any disclaimer, the term of this patent is extended or adjusted under 35 U.S.C. 154(b) by 45 days.

(21) Appl. No.: 13/862,522

(22) Filed: Apr. 15, 2013

(65) Prior Publication Data

US 2013/0279925 A1 Oct. 24, 2013

(30) Foreign Application Priority Data

Apr. 18, 2012 (JP) ..... 2012-094825

(51) Int. Cl.
*G03G 15/08* (2006.01)

(52) U.S. Cl.
CPC ..... *G03G 15/0824* (2013.01); *G03G 15/0858* (2013.01); *G03G 15/0862* (2013.01); *G03G 15/0849* (2013.01)

(58) Field of Classification Search
CPC ..... G03G 15/0856; G03G 15/0839; G03G 15/0824; G03G 15/0862; G03G 15/0849; G03G 15/0858
USPC ..... 39/27, 255; 399/27, 255
See application file for complete search history.

(56) References Cited

U.S. PATENT DOCUMENTS

2002/0021907 A1* 2/2002 Itoh ..... 399/27
2011/0026974 A1* 2/2011 Kunihiro et al. ..... 399/263
2013/0022372 A1* 1/2013 Bucks et al. ..... 399/254
2013/0308965 A1* 11/2013 Tsuchiya et al. ..... 399/27

FOREIGN PATENT DOCUMENTS

JP 2005-221859 A 8/2005

* cited by examiner

*Primary Examiner* — Ryan Walsh
*Assistant Examiner* — Philip Marcus T Fadul
(74) *Attorney, Agent, or Firm* — Marvin A. Motsenbocker; Mots Law, PLLC

(57) ABSTRACT

An image formation unit includes a developer storage configured to store developer, an image carrier on which an electrostatic latent image is formed, a developer carrier being in contact with the image carrier and configured to transfer developer to the electrostatic latent image, a developer housing portion located below the developer storage and above the image carrier and configured to house the developer from the developer storage, a supply port provided above the developer housing portion to communicate with the developer storage and configured to supply the developer in the developer storage into the developer housing portion, a developer amount detection member rotatably disposed in the developer housing portion at a position below the supply port, and protrusions disposed on the developer amount detection member.

20 Claims, 17 Drawing Sheets

INITIAL STATE
(LOWEST POINT)

AFTER ELAPSE OF T/2
(HIGHEST POINT)

T/2 + Δt
(AFTER DROP
UNDER ITS OWN WEIGHT)

TONER FULL

TONER LOW

TONER LOW

TONER FULL

IMMEDIATELY AFTER SUPPLY

AFTER ELAPSE OF Ta

AFTER ELAPSE OF Tb

IMMEDIATELY AFTER SUPPLY

AFTER ELAPSE OF T'a

AFTER ELAPSE OF Tb

IMAGE FORMATION UNIT AND IMAGE FORMATION APPARATUS

CROSS REFERENCE TO RELATED APPLICATIONS

This application claims priority based on 35 USC 119 from prior Japanese Patent Application No. 2012-094825 filed on Apr. 18, 2012, entitled "IMAGE FORMATION UNIT AND IMAGE FORMATION APPARATUS", the entire contents of which are incorporated herein by reference.

BACKGROUND OF THE INVENTION

1. Field of the Invention

The disclosure relates to an image formation unit and an image formation apparatus improved to solve problems of a deficiency in the amount of developer and an uneven distribution of the developer.

2. Description of Related Art

Image formation apparatuses having a function to solve problems of a deficiency of the amount of a developer, and an uneven distribution of the developer in an image formation unit, are generally known. Japanese Patent Application Publication No. 2005-221859 (Patent Document 1) is an example of such image formation apparatuses.

In the image formation apparatus of Patent Document 1, a stirring member is provided, in a longitudinal direction, in a portion of an image formation unit. The stirring member has functions to detect the amount of toner in the image formation unit and to stir the toner. The stirring member stirs the toner supplied through a toner supply port which is provided at the center, in the longitudinal direction, of the image formation unit. In other words, the stirring member detects the amount of toner as well as solves the problem of an uneven distribution of toner.

SUMMARY OF THE INVENTION

Even the conventional image formation apparatus of the above configuration cannot sufficiently solve the problem of uneven distribution of toner in some cases. In this case, image quality may be degraded.

A first aspect of the invention is an image formation unit that includes: a developer storage configured to store developer; an image carrier on which an electrostatic latent image is formed; a developer carrier being in contact with the image carrier and configured to transfer developer to the electrostatic latent image; a developer housing portion located below the developer storage and above the image carrier and configured to house the developer from the developer storage; a supply port provided above the developer housing portion to communicate with the developer storage and configured to supply the developer in the developer storage into the developer housing portion; a developer amount detection member rotatably disposed in the developer housing portion at a position below the supply port; and protrusions disposed on the developer amount detection member.

This aspect can bring the distribution of developer in the image formation unit close to being even, thus improving image quality.

DETAILED DESCRIPTION OF EMBODIMENTS

Figure 1:
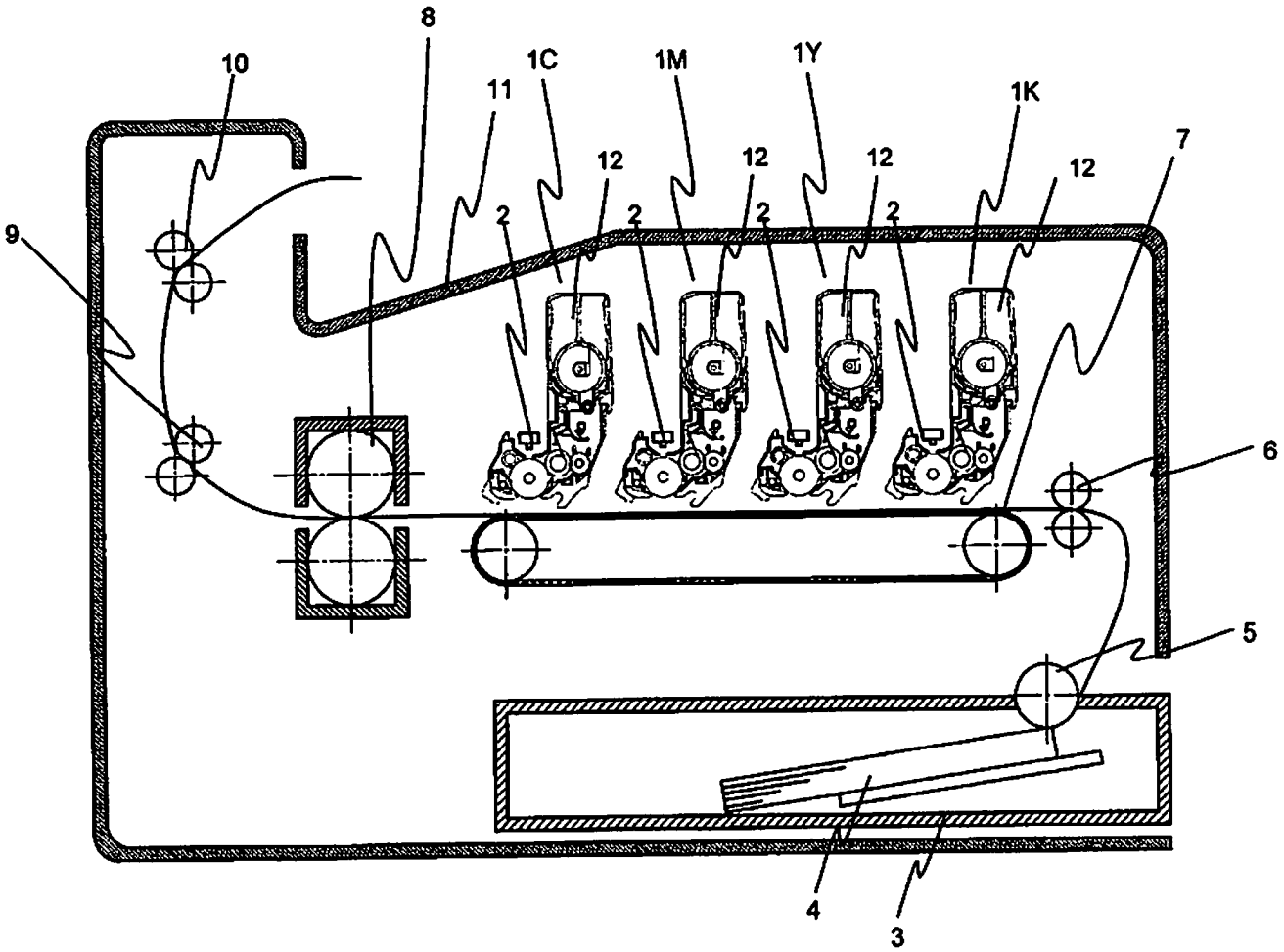
FIG. 1 is a cross-sectional view showing a schematic configuration of an image formation apparatus according to a first embodiment of the invention.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

Hereinbelow, an image formation unit and an image formation apparatus according to embodiments of the invention are described. Note that, in this specification, an image formation apparatus incorporating an image formation unit is described.

First Embodiment

First of all, a first embodiment of the invention is described. FIG. 1 is a cross-sectional view showing a schematic configuration of an image formation apparatus according to this embodiment. The image formation apparatus shown in FIG. 1 is an image formation apparatus capable of color printing, and has four image formation units. Specifically, the image formation apparatus has four image formation units 1K, 1Y, 1M, 1C for forming images of four colors, i.e., K (black), Y (yellow), M (magenta), and C (cyan). Exposure head 2 is disposed above later-described photosensitive drum 22 (see FIG. 2) of each of image formation units 1K, 1Y, 1M, 1C with a certain gap in between.

Tray 3 is disposed below image formation units 1K, 1Y, 1M, 1C, and medium 4 is stored in tray 3. Medium 4 is conveyed on a conveyance path formed by feed roller 5, conveyance rollers 6, and the like. Along the conveyance path for medium 4, there are disposed: image formation units 1K, 1Y, 1M, 1C; transfer belt 7 on which to transfer, onto medium 4, images formed by image formation units 1K, 1Y, 1M, 1C; fixing unit 8 configured to fix images transferred onto medium 4; ejection rollers 9, 10 configured to eject medium 4 outside the apparatus; and stacker cover 11 on which to keep ejected medium 4.

In addition, toner storage container 12, as a developer storage configured to store developer, is provided in an upper portion of each of image formation units 1K, 1Y, 1M, 1C. Toner storage containers 12 of image formation units 1K, 1Y, 1M, 1C store therein toners K, Y, M, and C of four colors, respectively.

Since image formation units 1K, 1Y, 1M, 1C have the same configuration and toner storage containers 12 have the same configuration, only one set of these is hereinafter described. Specifically, a set of image formation unit 1K of color K (black) and toner storage container 12 of image formation unit 1K is described.

Figure 2:
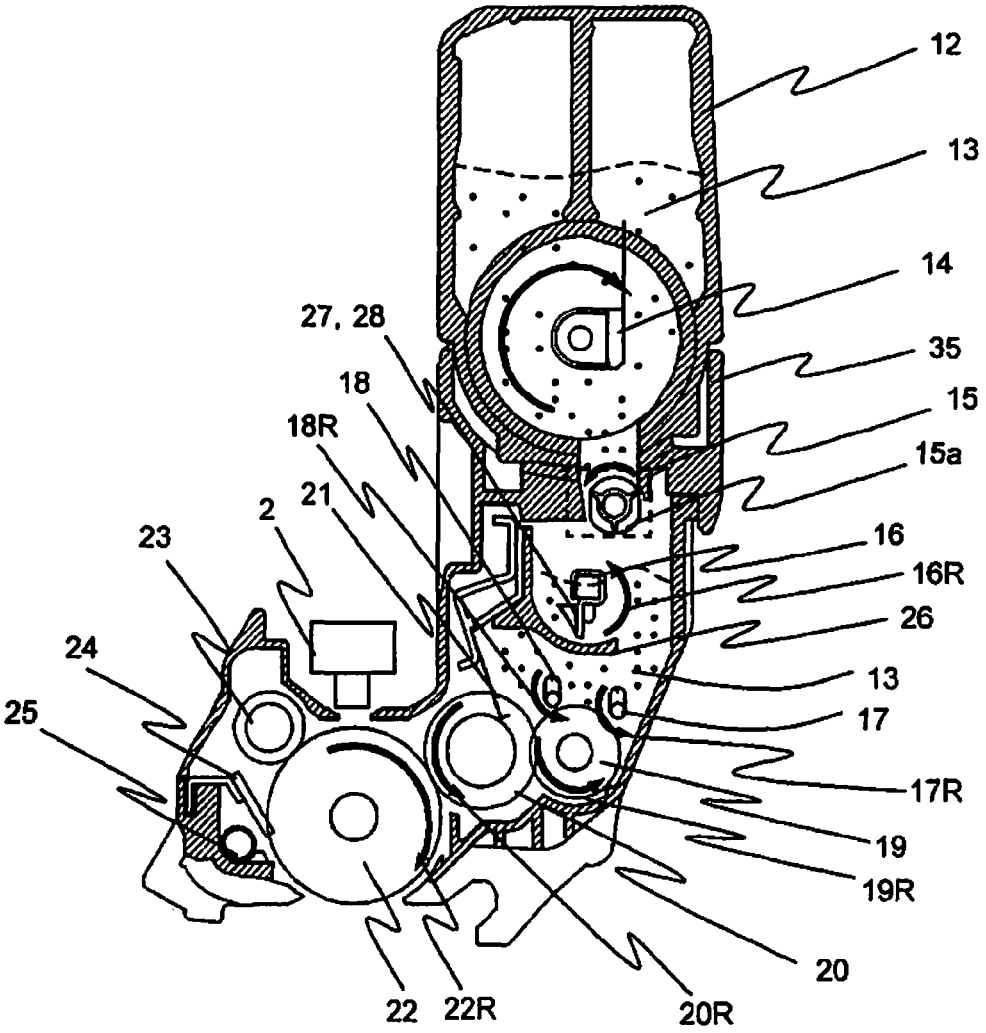
FIG. 2 is a cross-sectional view showing an image formation unit according to the first embodiment.

FIG. 2 is a cross-sectional view showing image formation unit 1K. Toner storage container 12 of image formation unit 1K in FIG. 2 includes stirring member 14 configured to stir toner 13 as a developer. Toner storage container 12 is provided with toner supply port 15 as a developer supply port at a position below stirring member 14. Toner supply port 15 is provided with rotatable shutter member 15*a* capable of opening and closing toner supply port 15. Developer housing portion S is provided inside image formation unit 1K. Developer housing portion S is a space located below toner storage container 12 and above photosensitive drum 22 as an image carrier. Developer housing portion S houses therein toner 13 supplied through toner supply port 15 of toner storage container 12. Toner 14 in toner storage container 12 is supplied to developer housing portion S of image formation unit 1K by opening toner supply port 15 by means of rotatable shutter member 15*a*. Toner supply port 15 is an opening for supplying toner 13 from toner storage container 12 to developer housing portion S. Toner supply port 15 is provided above a central portion, in a longitudinal direction, of developer housing portion S in such a way as to communicate with toner storage container 12.

Image formation unit 1K includes, in the inside: toner amount detection member 16 as a developer amount detection member; stirring members 17, 18; toner feed roller 19; and development roller 20 as a developer carrier.

Each of stirring members 17, 18 is a member for stirring toner 13. Stirring members 17, 18 are arranged inside developer housing portion S of image formation unit 1K in parallel with the longitudinal direction of developer housing portion S. Each of stirring members 17, 18 is rotatable. Toner 13 is stirred by rotation of stirring members 17, 18.

Toner feed roller 19 is a roller configured to feed toner 13 to development roller 20. Development roller 20 is a roller configured to hold, on its surface, a thin layer of toner 13 to be transferred to an electrostatic latent image on photosensitive drum 22. Development roller 20 transfers developer to the electrostatic latent image by contacting photosensitive drum 22. Development blade 21 is disposed in contact with development roller 20. Development blade 21 is a member configured to thin a layer of toner 13 on development roller 20, fed from toner feed roller 19. Photosensitive drum 22 is a roller on whose surface an electrostatic latent image can be formed. Charging roller 23 is a roller for charging the surface of photosensitive drum 22. Cleaning blade 24 is a member configured to scrape off toner 13 attached on the surface of photosensitive drum 22. Discarded toner conveyance member 25 is a device configured to discharge, to the outside, toner 13 scraped off of the surface of photosensitive drum 22 by cleaning blade 24.

Photosensitive drum 22 is disposed in contact with development roller 20. Charging roller 23 and cleaning blade 24 are disposed in contact with photosensitive drum 22. Discarded toner conveyance member 25 is disposed facing cleaning blade 24.

Next, toner amount detection member 16 is described.

Toner amount detection member 16 is a device configured to detect the amount of toner based on its rotation which varies in accordance with the amount of toner inside developer housing portion S. As shown in FIG. 2, toner amount detection member 16 is disposed below toner supply port 15. Toner amount detection member 16 is rotatably disposed, in a longitudinal direction, in a portion of image formation unit 1K.

Toner amount detection member 16 is in the form of a paddle having a flat surface that protrudes from its rotational axis toward one side in a radial direction. Thereby, toner amount detection member 16 has a configuration where its center of gravity is eccentric from the rotational axis toward the paddle. To put it differently, toner amount detection member 16 is a member which generates a moment of inertia to rotate toner amount detection member 16 in such a way that the center of gravity of toner amount detection member 16 is moved to its lowest point. This moment of inertia is a moment to rotate toner amount detection member 16 in such a way that the center of gravity of toner amount detection member 16 is moved to its highest point as toner amount detection member 16 is rotated, and is moved to the lowest point under the weight of the center of gravity once passing the highest point.

Figure 3:
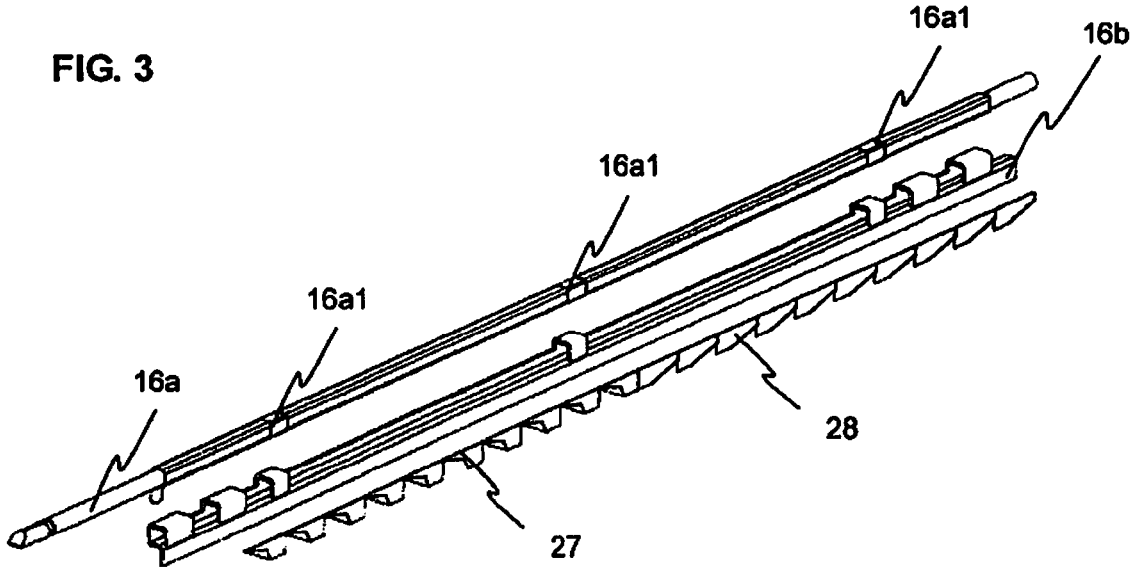
FIG. 3 is an exploded perspective view showing a toner amount detection member according to the first embodiment.

As shown in FIG. 3, toner amount detection member 16 mainly includes shaft portion 16*a* and plate-shaped portion 16*b*.

Shaft portion 16*a* is a member serving as the rotational axis of toner amount detection member 16. Shaft portion 16*a* is rotatably provided in developer housing portion S of image formation unit 1K. Later-described drive gear 31 (see FIG. 8) is provided in one end portion, in a longitudinal direction, of shaft portion 16*a*. Reflector plate 29 (see FIG. 8) of later-described sensor 30 is provided in the other end portion, in the longitudinal direction, of shaft portion 16*a*.

Plate-shaped portion 16*b* is a member being in direct contact with toner 13 and is configured to change a rotation stop position in accordance with the amount of toner. Plate-shaped portion 16*b* includes crimping portion 16*b*1 and paddle portion 16*b*2. Crimping portion 16*b*1 is a member for joining shaft portion 16*a* and plate-shaped portion 16*b* integrally. Shaft portion 16*a* and plate-shaped portion 16*b* are joined together by crimping crimping portion 16*b*1 into grooves 16*a*1 of shaft portion 16*a*. Paddle portion 16*b*2 is a member for stirring toner 13, making the center of gravity eccentric, and supporting protrusions 27, 28. Paddle portion 16*b*2 is formed of a plate-shaped member having a flat surface. More specifically, paddle portion 16*b*2 is formed of a flat plate extending in a rotational axis direction of toner amount detection member 16 and protruding in the radial direction thereof. Toner 13 is stirred by making plate-shaped paddle portion 16*b*2 rotate about shaft portion 16*a*.

Paddle portion 16*b*2 is a member for making eccentric the center of gravity of toner amount detection member 16. Toner amount detection member 16 is configured in such a way that paddle portion 16*b*2, where the center of gravity is located, is rotated about shaft portion 16*a* by a drive source and, once passing the highest point, paddle portion 16*b*2 rotates irrespective of the drive source to move to the lowest point by the action of the moment of inertia (under the weight of paddle portion 16*b*2 (the weight of the center of gravity)). In addition, by the rotation under its own weight, paddle portion 16*b*2 contacts toner 13 as well as changes the rotation stop position in accordance with the amount of toner. More specifically, paddle portion 16*b*2 stops its rotation at a position close to the lowest point when the amount of toner is small, and at a position far from the lowest point when the amount of toner is large.

Figure 4:
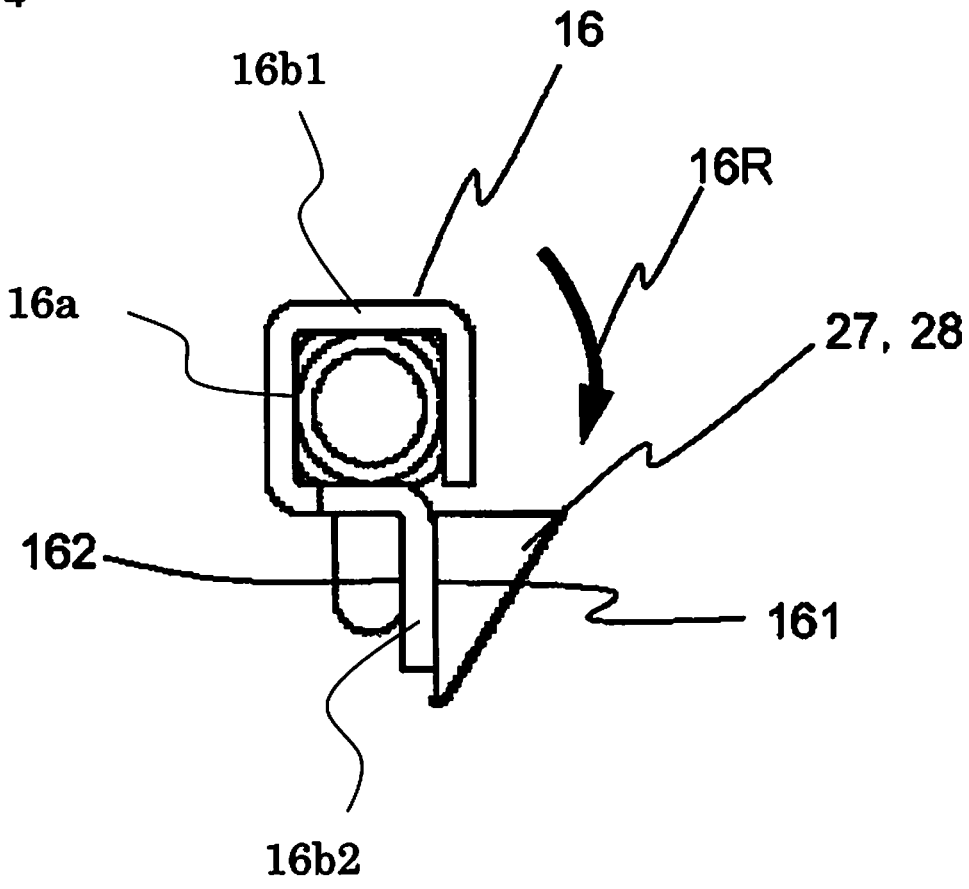
FIG. 4 is a front view showing the toner amount detection member according to the first embodiment.

Protrusions 27, 28 function to spread toner 13, in a longitudinal direction, in a central portion of toner amount detection member 16, toward two sides thereof in the longitudinal direction. Protrusions 27, 28 are each a member configured to scoop the toner with the rotation of toner amount detection member 16, and they work in conjunction with one another to spread toner 13, which is supplied through toner supply port 15, toward the two ends, in the longitudinal direction, of toner amount detection member 16. Multiple protrusions 27, 28 are arranged in paddle portion 16*b*2 of toner amount detection member 16 in parallel with one another at equal intervals. Protrusions 27, 28 together act like a screw to convey and spread toner 13, which is supplied to the vicinity of the center, in the longitudinal direction, of image formation unit 1K (developer housing portion S), toward the two ends thereof in the longitudinal direction. To this end, protrusions 27 are arranged on one side of image formation unit 1K and protrusions 28 are arranged on the other side thereof with respect to the center, in the longitudinal direction, of image formation unit 1K. Thereby, protrusions 27, 28 are capable of spreading toner 13 in the center, in the longitudinal direction, of image formation unit 1K toward the two sides thereof. As shown in FIG. 4, protrusions 27, 28 are formed from a bent film member. Protrusions 27, 28 are bonded to flat surface 161 of plate-shaped portion 16*b*, which is a trailing surface relative to the direction of rotation of toner amount detection member 16.

Figure 5:
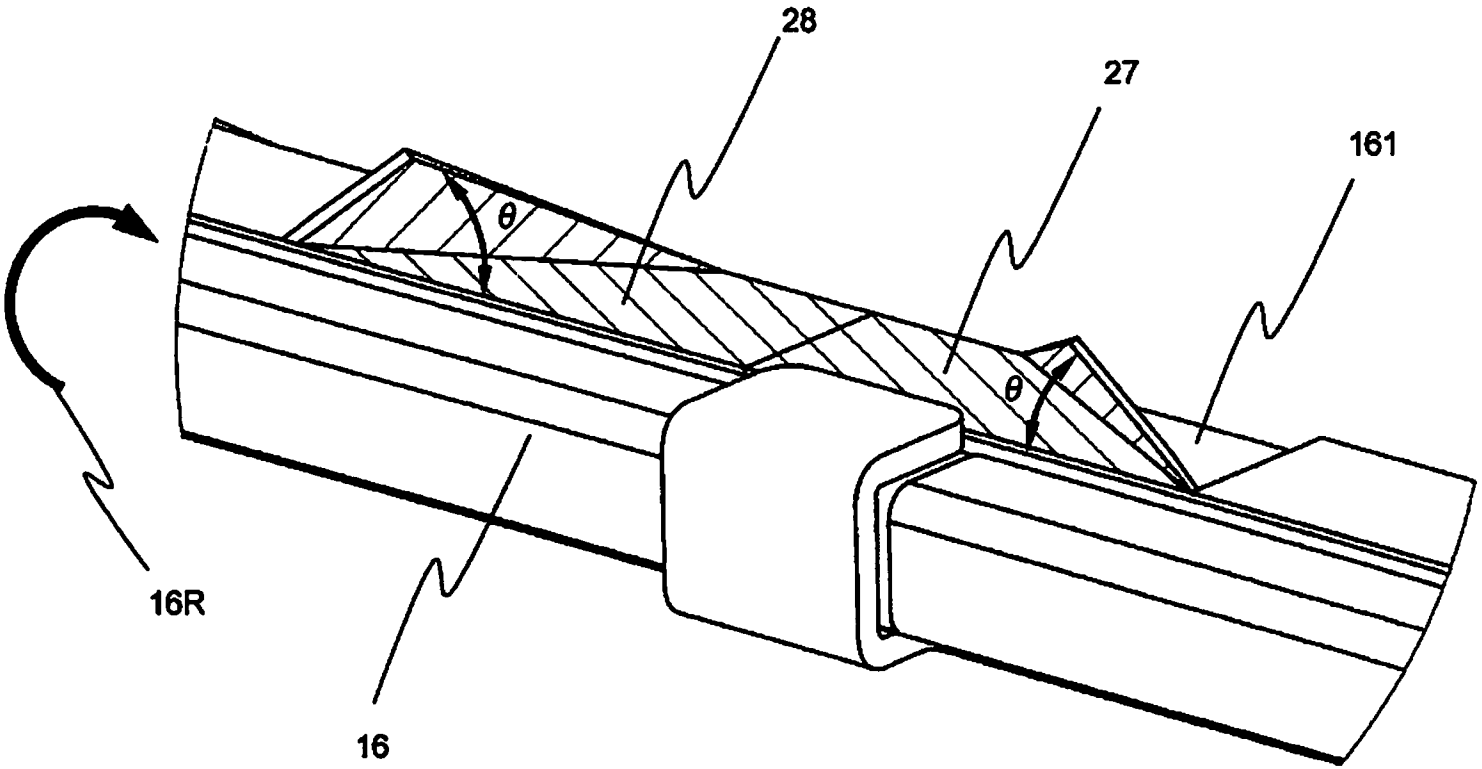
FIG. 5 is a perspective view showing a magnified version of a main part of the toner amount detection member according to the first embodiment.
Figure 6:
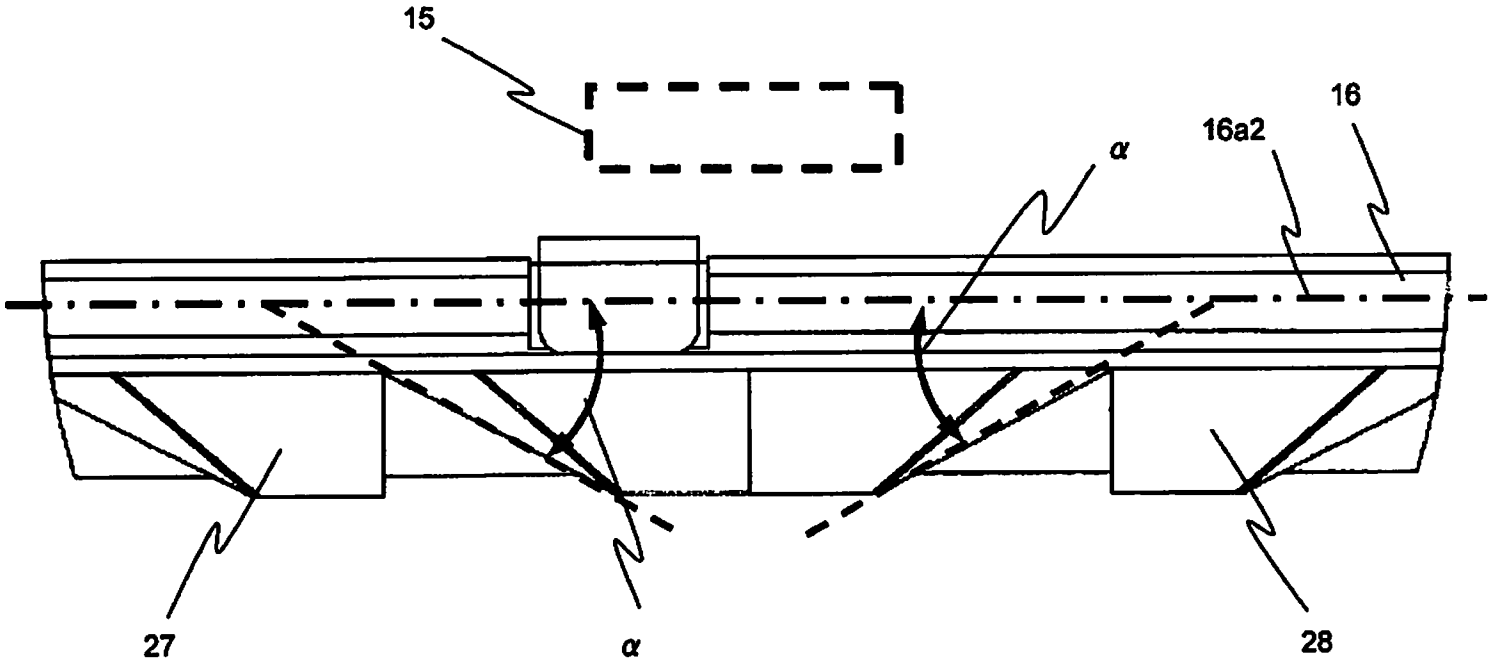
FIG. 6 is a side view showing a magnified version of the main part of the toner amount detection member according to the first embodiment.

In addition, as shown in FIG. 5, each of protrusions 27, 28 has a bent edge portion, and thereby protrudes from flat surface 161. This protrusion angle is set at $\theta=60°$. Each of protrusions 27, 28 is inclined at angle $\alpha$ in such a manner as to extend in a radial direction of rotational axis 16*a*2 from rotational axis 16*a*2 and in a direction from an end portion, in the radial direction, of flat surface 161 toward supply port 15. This angle $\alpha$ is set at $0°<\alpha<90°$. In this way, the film member bent at angles $\theta$ and $\alpha$ acts like blades of a screw. Thereby, protrusions 27, 28 each push toner 13 in the central portion, in the longitudinal direction, of toner amount detection member 16 toward the two sides thereof in the longitudinal direction, and they work in conjunction with one another to spread toner 13 in the central portion, in the longitudinal direction, of toner amount detection member 16 toward the two sides thereof in the longitudinal direction. Further, protrusions 27, 28 are bonded to flat surface 161 of plate-shaped portion 16*b*, which is the trailing surface relative to the direction of rotation of toner amount detection member 16, and thus do not disturb the toner amount detection function of toner amount detection member 16.

As shown in FIGS. 2, 7, 10A and 10B, enclosure member 26 covering toner amount detection member 16 is disposed around toner amount detection member 16. Enclosure member 26 is spaced a certain distance away from the rotation outer diameter of toner amount detection member 16. Enclosure member 26 has a shape covering an arc of (i.e. the lower 90 or more degrees of, see FIGS. 10A and 10B) the rotation trajectory drawn by toner amount detection member 16 when the member rotates from the highest point to the lowest point. Moreover, enclosure member 26 is formed covering the lowest point from below. Thereby, enclosure member 26 temporarily holds toner 13 supplied through toner supply port 15. Besides, the interval between the inner surface of enclosure member 26 and rotating toner amount detection member 16 is set small. Thereby, in combination with protrusions 27, 28, enclosure member 26 acts like a trough of a screw conveyor. Further, enclosure member 26 is formed covering the lowest point from below, thereby preventing the influence of the stir by stirring members 17, 18.

Figure 8:
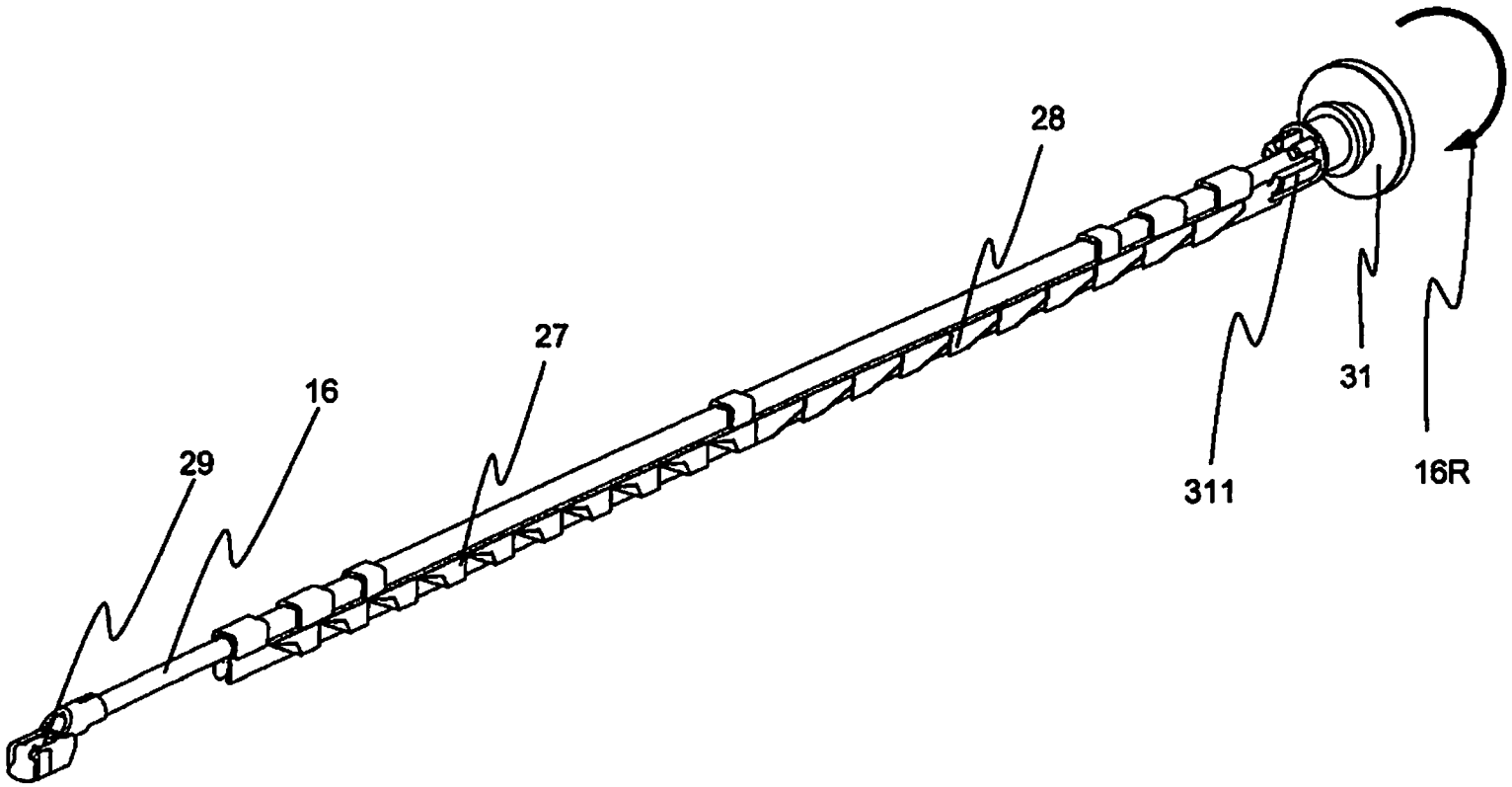
FIG. 8 is a perspective view showing the toner amount detection member according to the first embodiment.
Figure 9A:
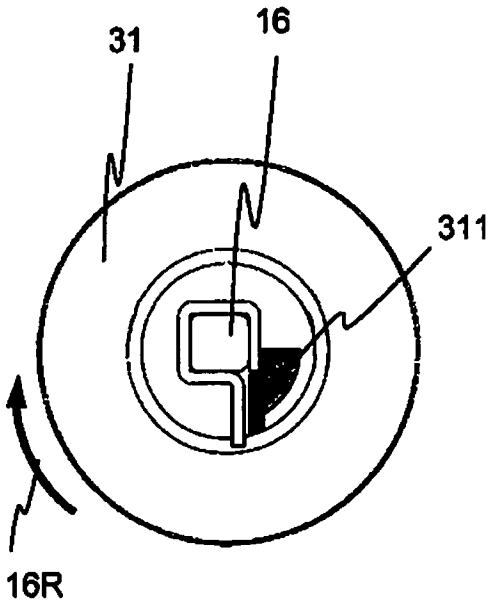
FIGS. 9A, 9B, and 9C are schematic views showing operations of the toner amount detection member according to the first embodiment.
Figure 9B:
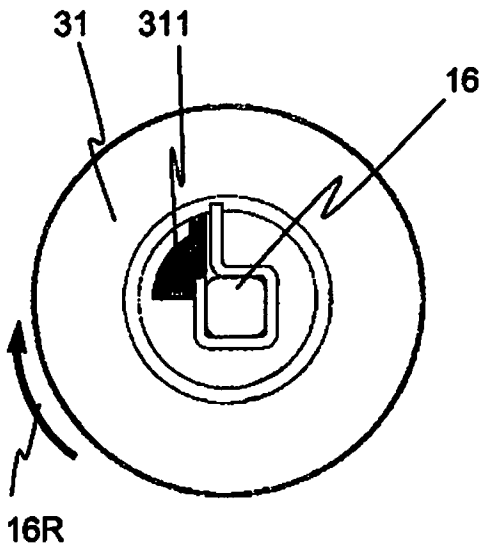

As shown in FIG. 8, drive gear 31 as a drive unit is disposed in one end portion, in the longitudinal direction, of toner amount detection member 16. Drive gear 31 is driven by a drive motor (not illustrated) as the drive source. Drive gear 31 has locking protrusion 311 configured to transmit the rotation of drive gear 31 to toner amount detection member 16. In this way, toner amount detection member 16 is rotated by the rotation of drive gear 31. Specifically, locking protrusion 311 contacts one surface (a right lateral surface in FIG. 8) of paddle portion 16*b*2 of toner amount detection member 16 to rotate toner amount detection member 16. More specifically, as shown in FIG. 9A, locking protrusion 311 contacts the one surface of paddle portion 16*b*2 of toner amount detection member 16 located at the lowest point. Then, once toner amount detection member 16 is rotated to the highest point as shown in FIG. 9B, paddle portion 16*b*2 of toner amount detection member 16 moves away from locking protrusion 311 and rotates to the lowest point under its own weight.

Figure 7:
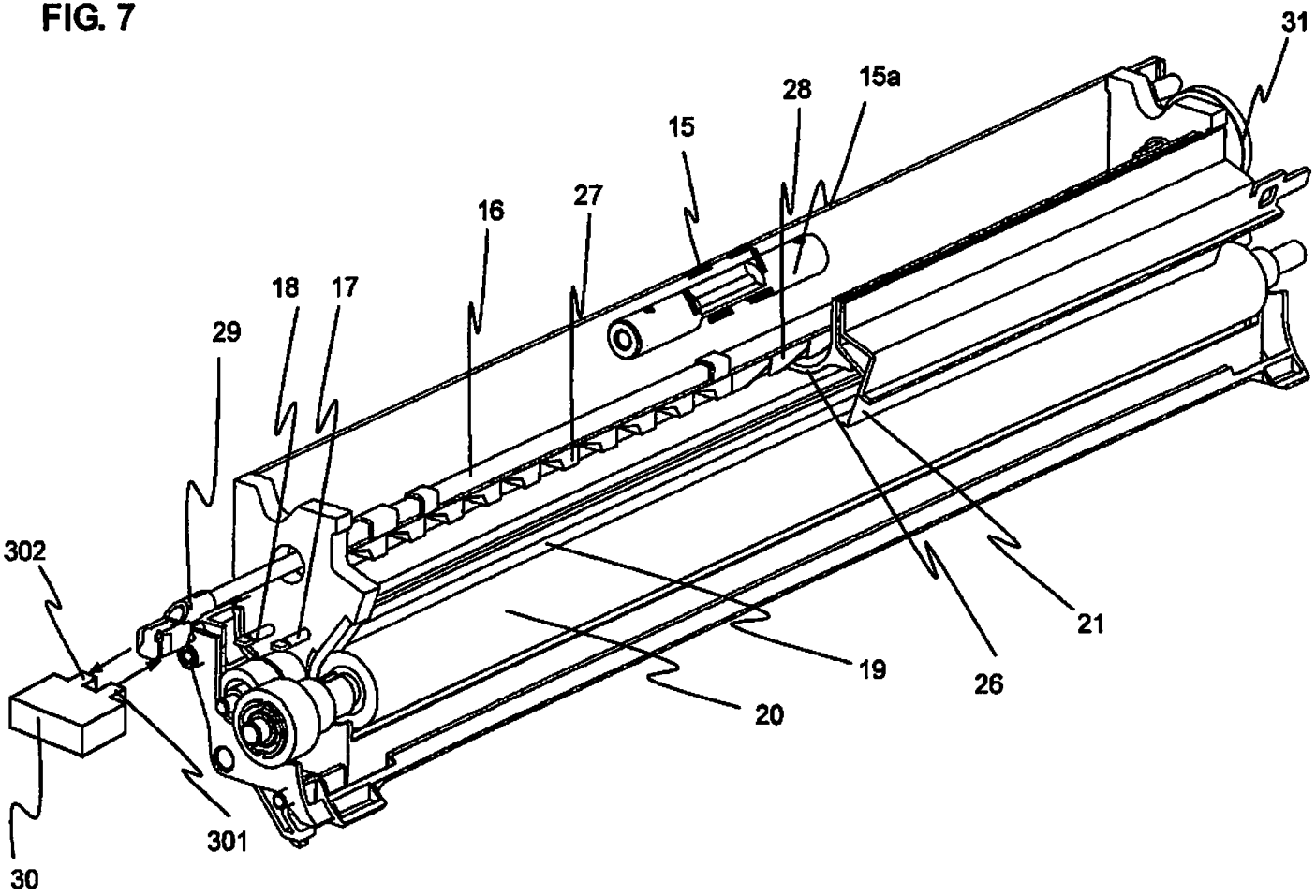
FIG. 7 is a perspective view showing the image formation unit according to the first embodiment.

As shown in FIGS. 7 and 8, reflector plate 29 is disposed in the other end portion, in the longitudinal direction, of toner amount detection member 16. Reflector plate 29 is used for sensor 30. Sensor 30 is configured to emit test light to reflector plate 29 and receive reflected light. Sensor 30 is disposed at a position opposed to reflector plate 29, which rotates together with toner amount detection member 16, at the time when reflector plate 29 is located at the lowest point on the rotation trajectory of reflector plate 29. Sensor 30 includes light emission portion 301 and light reception portion 302. Sensor 30 detects that the amount of remaining toner is reduced when light reception portion 302 receives test light emitted from light emission portion 301 and reflected by reflector plate 29 located at the lowest point. More specifically, when toner 13 is so reduced that paddle portion 16*b*2 of toner amount detection member 16 rotates to the lowest point without being blocked by toner 13, light reception portion 302 detects reflected light, and thereby sensor 30 detects that the amount of remaining toner is reduced.

As shown in FIG. 1, controller C configured to control the entire operation is provided inside the image formation apparatus. Controller C is connected to image formation units 1K, 1Y, 1M, 1C, feed roller 5, and the like and controls these components.

The image formation apparatus having the above configuration operates as follows.

In FIG. 1, upon receipt of a print instruction from controller C, medium 4 is separated from the others one by one by feed roller 5. Separated medium 4 is conveyed to transfer belt 7 by conveyance rollers 6. Meanwhile, development according to a later-described development process is carried out in each of image formation units 1K, 1Y, 1M, 1C, and toner 13 is transferred onto medium 4 conveyed on transfer belt 7. Medium 4 on which toner 13 is transferred passes through fixing unit 8 where toner 13 is fixed thereon. Medium 4 is then ejected to stacker cover 11 by ejection rollers 9, 10 and held on stacker cover 11.

The development process in each of image formation units 1K, 1Y, 1M, 1C is described based on FIG. 2. Note that, since image formation units 1K, 1Y, 1M, 1C have the same configuration, only image formation unit 1K of color K (black) is described. Upon receipt of a print instruction from controller C, feed roller 19 is rotated by a drive source (not illustrated) in a direction indicated by arrow 19R. Thereby, toner 13 is fed to development roller 20 rotated in a direction indicated by arrow 20R. At this time, stirring members 17, 18 are also rotated in directions indicated by arrows 17R, 18R respectively to stir toner 13. A layer of toner 13 fed to development roller 20 is thinned by development blade 21 and charged.

In the meantime, the surface of photosensitive drum 22 rotated in a direction indicated by arrow 22R is charged by charging roller 23. Photosensitive drum 22 is then exposed by exposure head 2, whereby an electrostatic latent image is formed on photosensitive drum 22. Toner 13 on development roller 20 moves to this electrostatic latent image, and thereby the exposed part is developed. After that, the image is transferred to medium 4. Toner 13 left on photosensitive drum 22 is scraped off by cleaning blade 24. Toner 13 thus scraped off is conveyed and discharged to the outside by discarded toner conveyance member 25.

Next, operations of toner amount detection member 16 and of the toner supply are described.

Figure 9C:
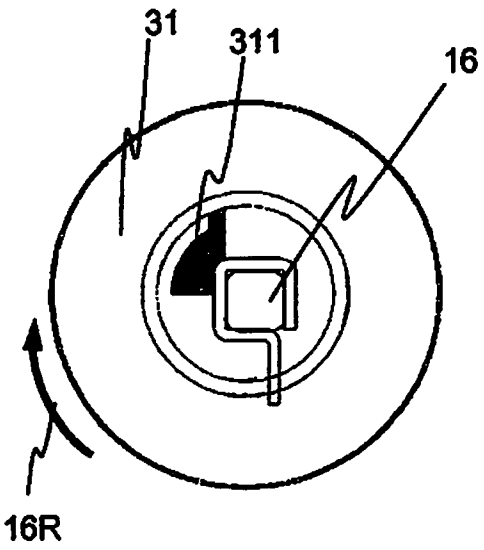

As shown in FIG. 9A, paddle portion 16*b*2 of toner amount detection member 16 located at the lowest point is rotated in a manner pushed upward from the lowest point to the highest point by the action of locking protrusion 311 of drive gear 31. Here, locking protrusion 311 of drive gear 31 is rotated in the direction indicated by arrow 16R, which is the same as that of toner amount detection member 16, at rotation period T. Hence, as shown in FIG. 9B, paddle portion 16*b*2 reaches the highest point after the elapse of T/2. Then, once passing the highest point, paddle portion 16*b*2 rotates and drops to the lowest point under its own weight because the center of gravity is eccentric, as shown in FIG. 9C.

Figure 10B:
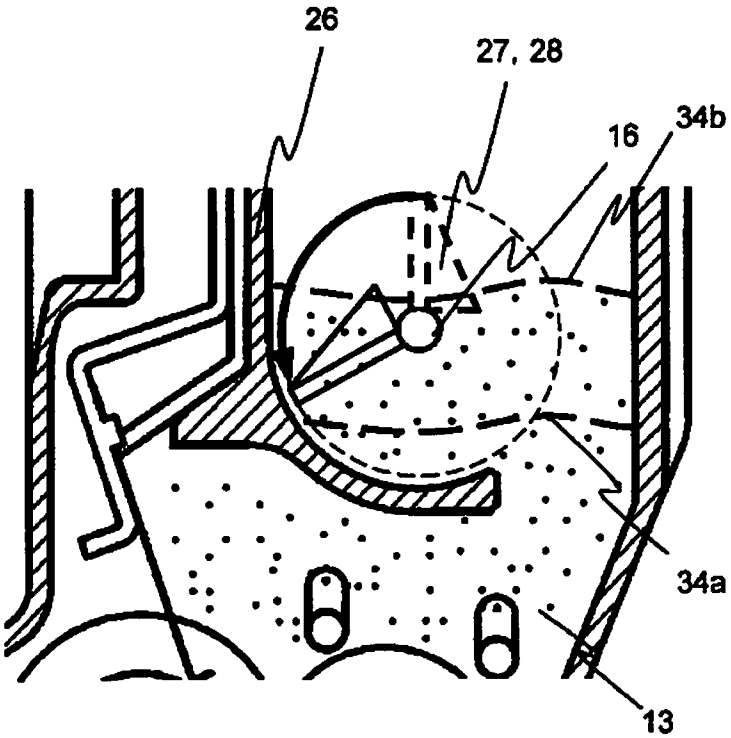
FIGS. 10A and 10B are cross-sectional views showing a magnified version of a main part of the image formation unit according to the first embodiment.
Figure 10A:
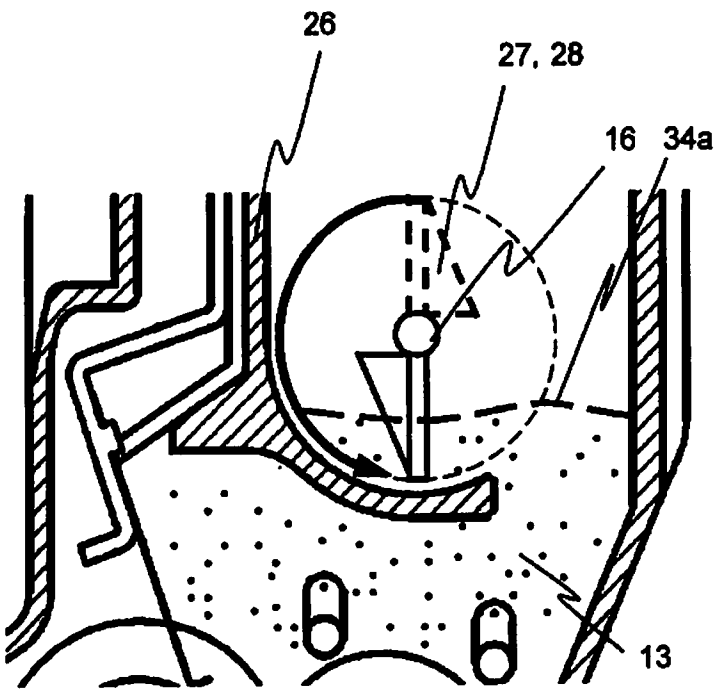
Figure 11A:
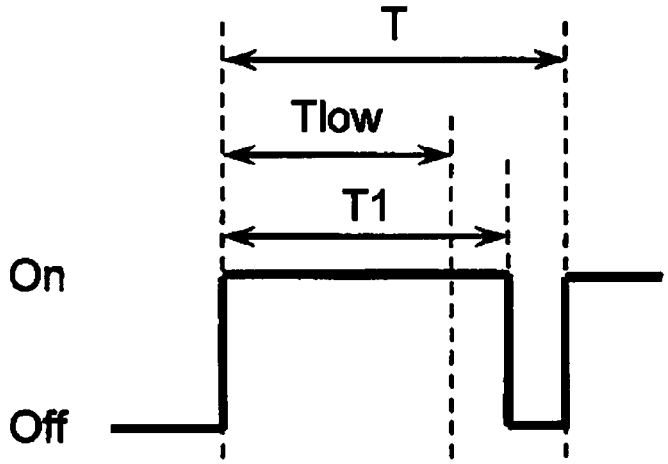
FIGS. 11A and 11B are time charts showing time periods in which the toner amount detection member according to the first embodiment stays at the lowest point.

In the state where the amount of toner 13 in image formation unit 1K is small (such a state is termed as "toner low") and the level of toner upper surface 34*a* is low as shown in FIG. 10A, toner amount detection member 16 hardly receives pressure from toner 13. For this reason, paddle portion 16*b*2 of toner amount detection member 16 drops to the lowest point under its own weight and reaches the lowest point earlier than locking protrusion 311. Accordingly, paddle portion 16*b*2 of toner amount detection member 16 is located at the lowest point as also is reflector plate 29. Because sensor 30 is disposed opposed to the lowest point on the rotation trajectory of reflector plate 29, the test light emitted from light emission portion 301 of sensor 30 is reflected by reflector plate 29. Light reception portion 302 receives the reflected light, and sensor 30 thereby detects the position of toner amount detection member 16. Controller C acquires a time period in which toner amount detection member 16 stays at the lowest point. Then, controller C judges that image formation unit 1K is in the state of "toner low" if stay period T1 is longer than set period Tlow set in advance, as shown in FIG. 11A.

Figure 12A:
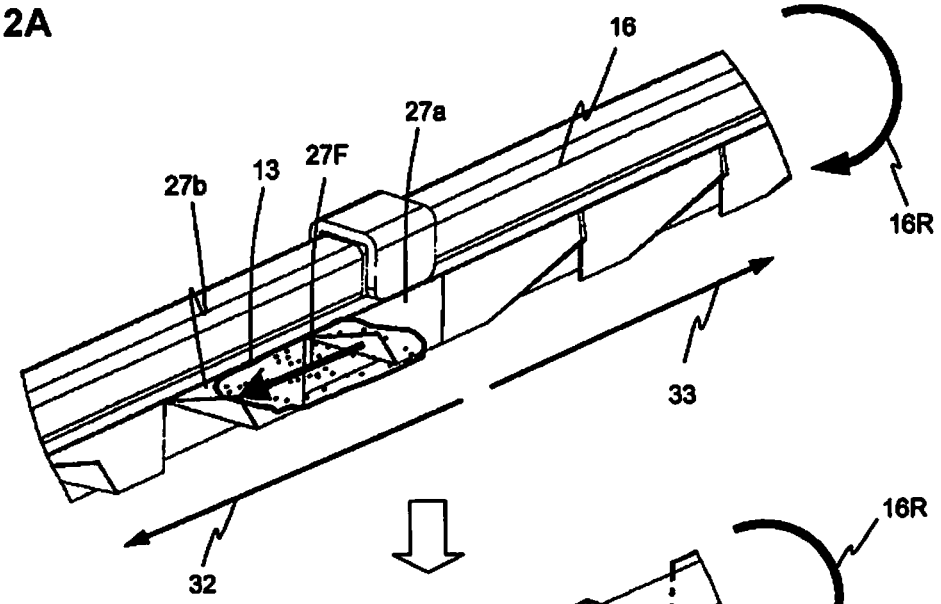
FIGS. 12A, 12B, and 12C are schematic views showing operations of protrusions of the toner amount detection member according to the first embodiment.
Figure 12B:
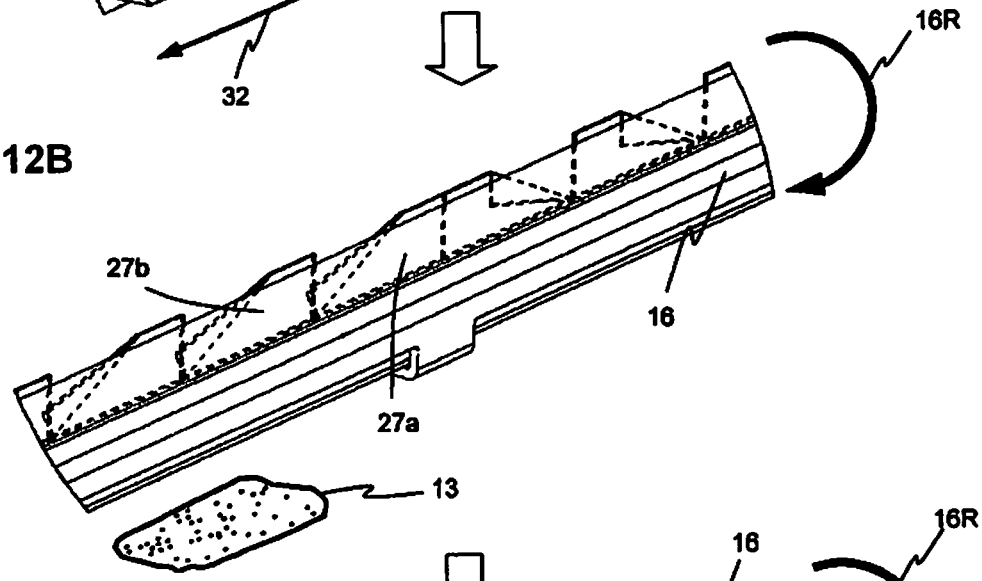
Figure 12C:
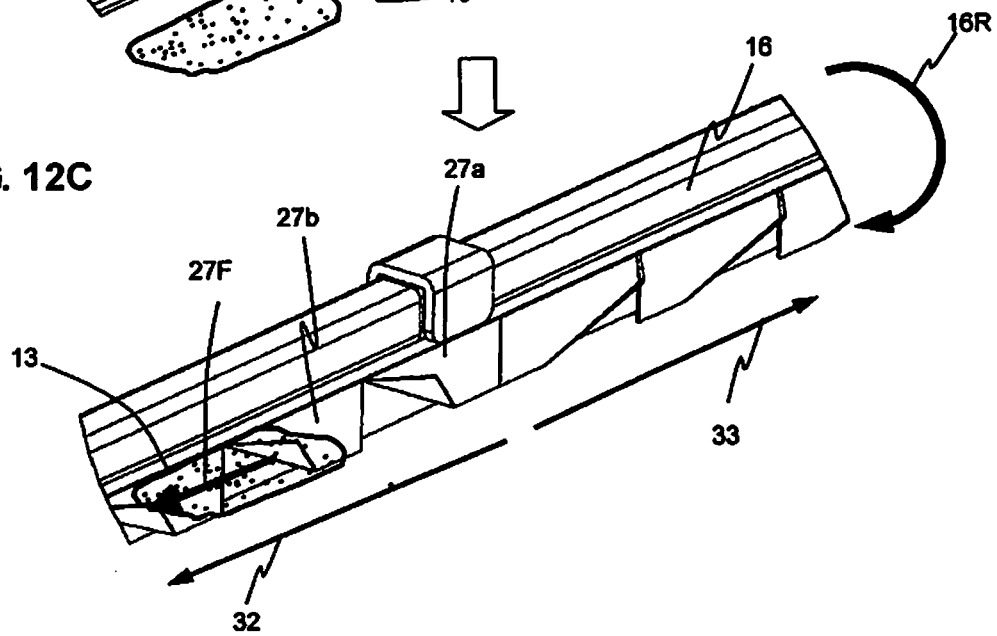

If judging that image formation unit 1K is in the state of "toner low", controller C issues a toner supply instruction. Upon issue of this instruction, rotatable shutter member 15*a* is rotated by a drive unit (not illustrated). By this rotation, toner 13 drops from toner storage container 12 and is supplied to image formation unit 1K. In this event, since toner supply port 15 is provided in the vicinity of the center, in the longitudinal direction, of image formation unit 1K, toner 13 is supplied to the vicinity of the center, in the longitudinal direction, of image formation unit 1K. Then, since multiple protrusions 27 (27*a*, 27*b* . . . ) are rotated as shown in FIGS. 12A, 12B, and 12C, protrusions 27 act like blades of a screw conveyor and produce force 27F to push toner 13 in the axial directions of toner amount detection member 16. Thus, toner 13 supplied through toner supply port 15 is first pushed by protrusion 27*a* in the vicinity of the center, in the longitudinal direction, of image formation unit 1K and conveyed toward one side, in the longitudinal direction, of toner amount detection member 16 (in a direction indicated by arrow 32 in this example), and reaches protrusion 27*b* next to protrusion 27*a*. Likewise, protrusion 27*b* conveys toner 13 in the direction indicated by arrow 32. By repeating this operation, supplied toner 13 is conveyed in the directions away from supply port 15 and never accumulates near an area below supply port 15.

In this operation, enclosure member 26 covers a lower part of the rotation trajectory of protrusions 27, 28, and temporarily holds toner 13. In this manner, enclosure member 26 suppresses the influence of stirring members 17, 18 located near toner amount detection member 16 and thus enables protrusions 27, 28 of toner amount detection member 16 to convey toner 13 smoothly.

In the same way, multiple protrusions 28 rotate and produce a force in an opposite direction from push force 27F of multiple protrusions 27, and thereby convey toner 13 toward the other side, in the longitudinal direction, of toner amount detection member 16 (in a direction indicated by arrow 33 in this example).

In addition, as shown in FIGS. 4 and 10, since protrusions 27, 28 are disposed on trailing surface 161 relative to the direction of rotation of toner amount detection member 16, smooth surface 162 having no protrusions 27, 28 always contacts toner upper surfaces 34*a*, 34*b* when the paddle portion drops under its own weight. For this reason, protrusions 27, 28 never affect the toner amount detection.

As the amount of supplied toner 13 accumulating on enclosure member 26 becomes larger, toner amount detection member 16 receives more pressure from toner 13. Accordingly, toner amount detection member 16 rotates in conjunction with locking protrusion 311 of drive gear 31 without dropping under its own weight.

Figure 11B:
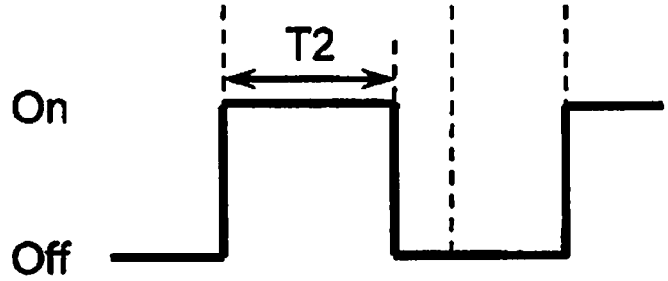

Hence, stay period T2 in which toner amount detection member 16 stays at the lowest point becomes shorter as the amount of accumulating toner increases (i.e., stay period T2 becomes shorter as the time passes since the start of the toner supply). If stay period T2 becomes shorter than set period Tlow as shown in FIG. 11B, controller C detects a state of "toner full" (i.e. an increase in the level of toner upper surface 34*b* shown in FIG. 10B). After detecting the state of "toner full", controller C issues an instruction to stop rotatable shutter member 15*a* to stop the toner supply operation.

Figure 13A:
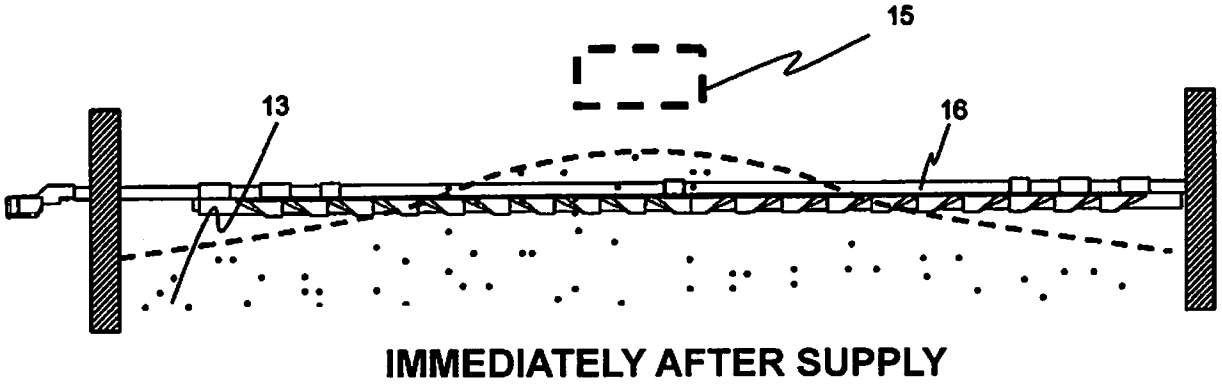
FIGS. 13A and 13B are schematic views showing a change of toner before and after being leveled by the protrusions of the toner amount detection member according to the first embodiment.
Figure 13B:
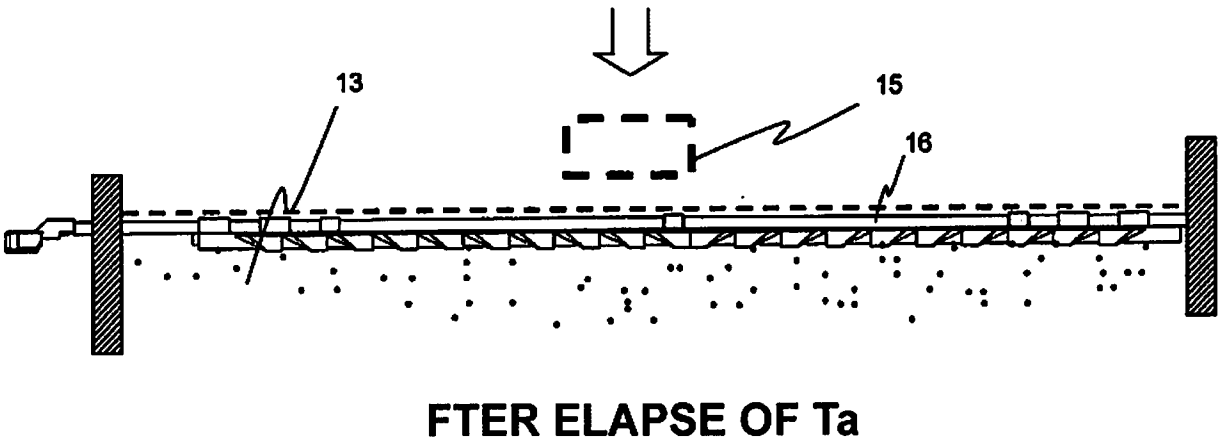

As shown in FIG. 13A, toner 13 is piled up near supply port 15 and exhibits an uneven distribution immediately after the stopping of the toner supply. However, because toner 13 is stirred and conveyed by protrusions 27, 28, toner 13 exhibits an even distribution after the elapse of period Ta to a level toner, as shown in FIG. 13B.

Figure 14:
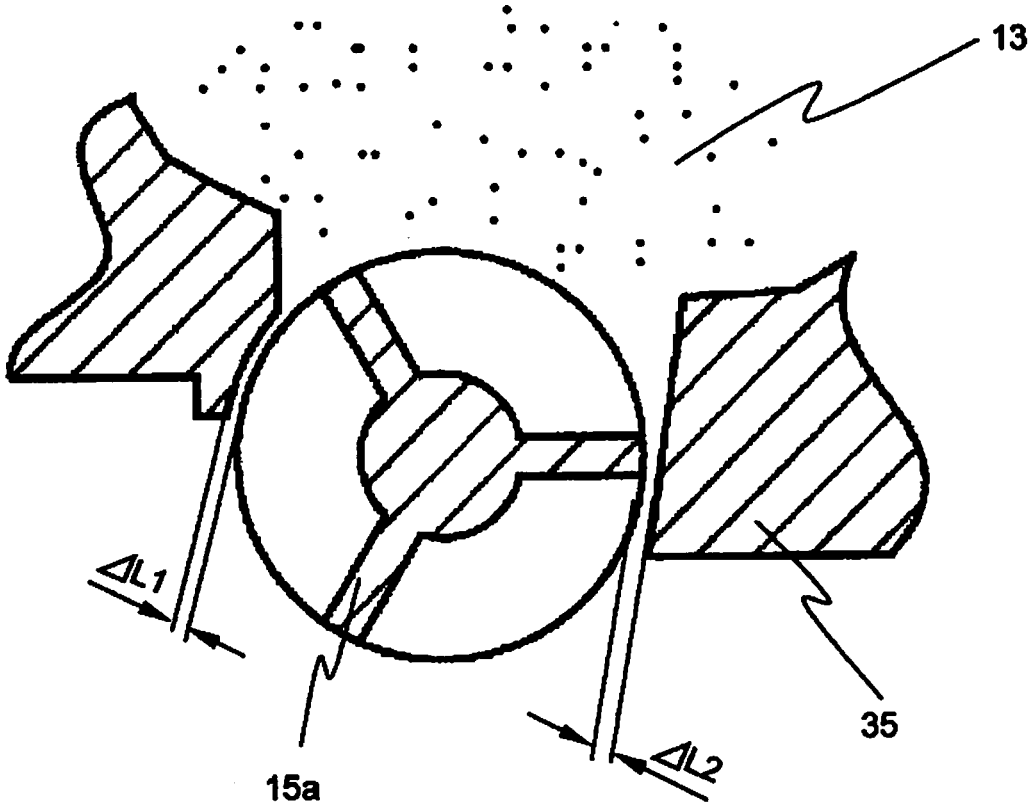
FIG. 14 is a cross-sectional view showing a toner supply port of the image formation unit according to the first embodiment.

As shown in FIG. 14, minute gaps ΔL1, ΔL2 are established between rotatable shutter member 15*a* and cover 35, making rotatable shutter member 15*a* rotatable. In addition, because gaps ΔL1, ΔL2 are minute, toner 13 having entered the gaps accumulates in the gaps. Hence, toner 13 in toner storage container 12 is held without dropping through the gaps.

As described above, protrusions 27, 28 are provided to toner amount detection member 16 in this embodiment. Hence, toner 13 can be stirred and conveyed by the protrusions 27, 28 even in the case where the fluidity of toner 13 is reduced due to deterioration of toner 13 or the like. Thus, toner 13 can be distributed evenly. This makes it possible to prevent toner 13 from accumulating near toner supply port 15, and thereby to keep a good toner amount detection accuracy while preventing a deterioration thereof.

In addition, the problems of a deficiency of the amount of toner and an uneven distribution of toner are solved. Thereby, it is possible to keep a good image quality while preventing a deterioration thereof.

Further, the stir/conveyance of toner 13 and the toner amount detection can be carried out by the single component (toner amount detection member 16), making it possible to reduce the number of components and cost.

On the other hand, in the case of the conventional image formation apparatus having no protrusions 27, 28, it is sometimes impossible to sufficiently solve the problem of an uneven distribution of toner caused when the fluidity of toner is reduced due to a deterioration of the toner or the like. To put it differently, when the fluidity of toner is reduced in the conventional image formation apparatus due to a deterioration of the toner or the like, toner is likely to accumulate near a toner supply port and, therefore, it is sometimes impossible to keep a good toner amount detection accuracy of image formation units. If a good toner amount detection accuracy cannot be kept, a deficiency in the amount of toner and an uneven distribution of toner in the image formation units occur, which in turn deteriorates the image quality.

Second Embodiment

Figure 15:
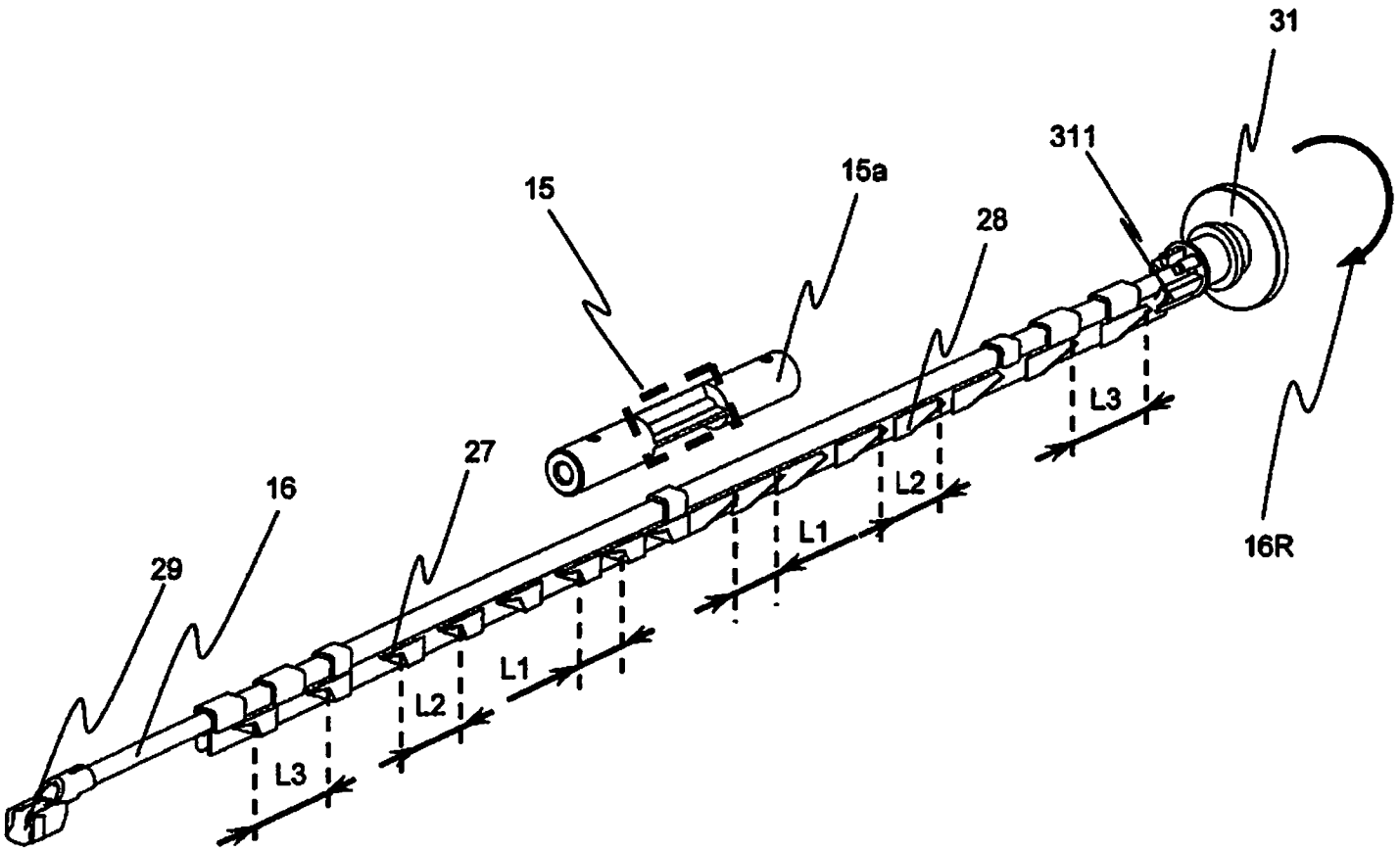
FIG. 15 is a perspective view showing a toner amount detection member according to a second embodiment of the invention.

Next, a second embodiment of the invention is described. The overall configuration of an image formation apparatus of this embodiment is almost the same as that of the image formation apparatus of the first embodiment. Thus, the same components are given the same reference numerals and are not described again. FIG. 15 is a perspective view showing toner amount detection member 16 according to this embodiment.

Toner amount detection member 16 of this embodiment has variations in intervals at which protrusions 27, 28 are arranged. Specifically, unlike in the first embodiment where all protrusions 27, 28 are arranged at equal intervals, protrusions 27, 28 of this embodiment are arranged in such a way that their arrangement interval gradually increases. More specifically, arrangement interval L increases away from toner supply port 15. As shown in FIG. 15, the values of L1 close to toner supply port 15, L2 farther from toner supply port 15 than L1, and L3 farther from toner supply port 15 than L2 are defined to gradually increase in the following way:

L1<L2<L3. The configuration of the apparatus of this embodiment is the same as that of the first embodiment except for this point.

The image formation apparatus having the above configuration operates as follows. Note that, since the overall operation of the apparatus is the same as that of the first embodiment, the operation of protrusions 27, 28 is mainly described here.

As in the first embodiment, toner 13 is conveyed in the axial directions of toner amount detection member 16 by the rotation of toner amount detection member 16 and protrusions 27, 28. In this event, because the arrangement interval of protrusions 27, 28 is small near toner supply port 15, toner 13 can reach next protrusions 27, 28 quickly. Thus, the amount of toner which can be conveyed is large.

By contrast, the arrangement interval of protrusions 27, 28 is large at positions far from toner supply port 15. Accordingly, portions with no protrusions 27, 28 are each large, making it difficult to convey toner 13 in the axial directions. Thus, the amount of toner which can be conveyed becomes smaller away from supply port 15.

The operations of the apparatus of this embodiment are the same as those of the first embodiment except for the above.

Figure 16A:
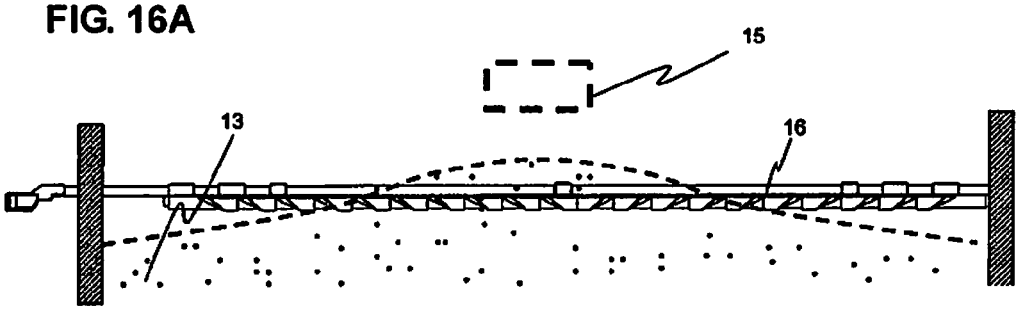
FIGS. 16A, 16B, and 16C are schematic views showing changes in the accumulation state of toner before and after being leveled by the protrusions of the toner amount detection member of the first embodiment.
Figure 16B:
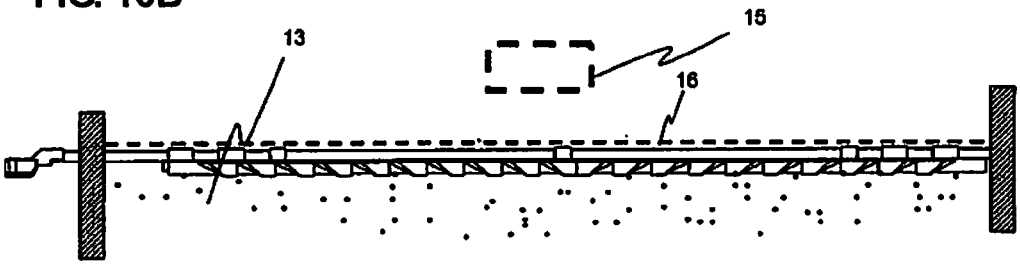
Figure 16C:
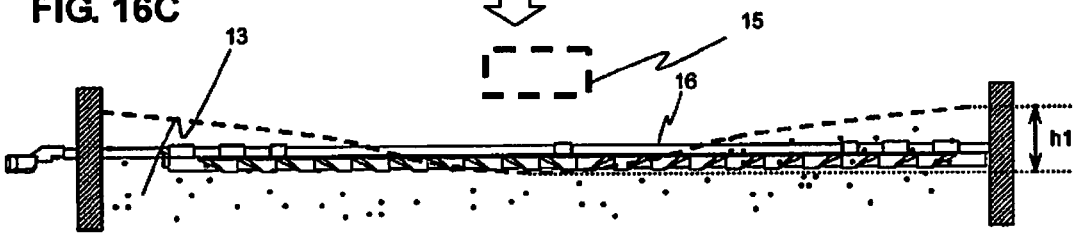

In the first embodiment, the toner distribution which is uneven immediately after the toner supply, as shown in FIG. 16A, becomes even after the elapse of period Ta to a level toner as shown in FIG. 16B. In this case, if toner is not supplied for a long period (e.g. in the case where toner 13 is not consumed so much because low-density printing is repeated), toner 13 gathers at both ends of image formation unit 1K and exhibits an uneven distribution as shown in FIG. 16C after the elapse of stir period Tb. The difference between the levels of toner 13 (toner distribution difference) inside image formation unit 1K at this time is set at h1, which is a difference between the levels of toner upper surfaces in a central portion, in the longitudinal direction of image formation unit 1K, and in each end portion thereof in the longitudinal direction.

Figure 17A:
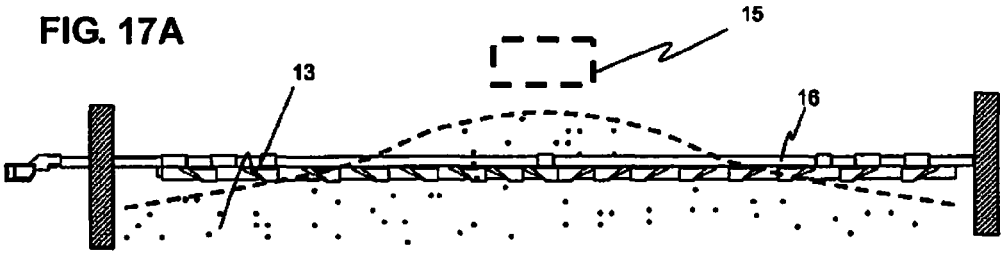
FIGS. 17A, 17B, and 17C are schematic views showing changes in the accumulation state of toner before and after being leveled by protrusions of the toner amount detection member of the second embodiment.
Figure 17B:
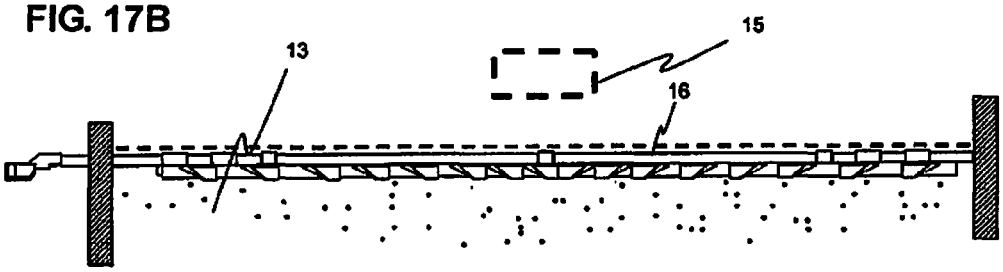
Figure 17C:
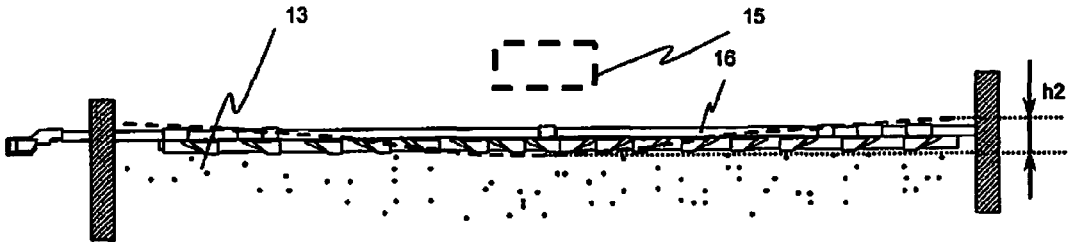

On the other hand, in this embodiment where the arrangement interval of protrusions 27, 28 is adjusted, the toner distribution, which is uneven immediately after the toner supply as shown in FIG. 17A, becomes even after the elapse of period Ta' to level toner as shown in FIG. 17B, and then becomes uneven after the elapse of stir period Tb as shown in FIG. 17C. The toner distribution difference at this time is set at h2.

In both the first and second embodiments, the distribution of toner 13 becomes uneven after the elapse of period Tb to a degree not adversely affecting a print image. However, since the amount of toner which can be conveyed varies because of the variations in the interval of protrusions 27, 28, the toner distribution difference inside image formation unit 1K in these embodiments results in h1>h2. Thus, the second embodiment enables the toner distribution to be kept closer to an even distribution when evenly distributed toner is further stirred. As a result, it is possible to keep a good toner amount detection accuracy while more effectively preventing a deterioration thereof, and also to keep a good image quality while more effectively preventing deterioration thereof due to a deficiency in the amount of toner and an uneven distribution of the toner.

It should be noted that the invention relates to an image formation unit which is applicable to various image formation apparatuses. For example, the image formation unit of the invention is applicable to image formation apparatuses used as copiers, LED printers, laser printers, facsimiles, MFPs, and the like.

In addition, although the arrangement interval L of protrusions 27, 28 is increased gradually away from toner supply port 15 in the second embodiment, this arrangement interval L may be set more exactly. Specifically, since toner 13 has fluidity, and even deteriorated toner has fluidity to some extent, arrangement interval L of protrusions 27, 28 may be adjusted accordingly. More specifically, arrangement interval L of protrusions 27, 28 may be adjusted so that the amount of toner 13 flowing toward the center, in the longitudinal direction, of toner amount detection member 16 attributable to the fluidity of a deteriorated toner balances with the amount of toner conveyed toward the two sides thereof in the longitudinal direction by toner amount detection member 16 of the second embodiment. The amount of toner 13 to flow toward the center of toner amount detection member 16 that is attributable to the fluidity of deteriorated toner varies depending on various conditions, such as the degree of deterioration of toner 13. Accordingly, in a practical case, the values of the fluidity of toner according to these conditions are determined through experiments. Then, arrangement interval L of protrusions 27, 28 is adjusted so as to balance with the fluidity of the toner. Thereby, the toner distribution difference h2 can be reduced to a value close to 0. Further, angles $\theta$, $\alpha$ of protrusions 27, 28 may be adjusted instead of, or together with, the adjustment of arrangement interval L of protrusions 27, 28.

The apparatus in each of the embodiments has a configuration where toner supply port 15 is provided to the central portion, in the longitudinal direction, of developer housing portion S and protrusions 27, 28 of toner amount detection member 16 spread toner 13 in the central portion thereof in the longitudinal direction toward the two sides thereof. However, the apparatus may have another configuration. Specifically, toner supply port 15 may be disposed, not in the central portion in the longitudinal direction of developer housing portion S, but in a portion slightly shifted left or right from the central portion, or in a portion largely shifted left or right from the central portion. In this case, a set of protrusions 27 and a set of protrusions 28 are arranged left and right about a position immediately under toner supply port 15. In the case where toner supply port 15 is provided at left or right ends of toner amount detection member 16, only protrusions 27 or only protrusions 28 are provided. In either case, the same working effect as those of the above embodiments can be achieved.

Moreover, although the four image formation units are provided for color printing in the above embodiments, only one image formation unit is provided in the case of monochrome printing. The invention is also applicable to this case.

In addition, the invention is not limited to the above embodiments, but may be embodied by modifying the constituents thereof within a range not departing from the spirit of the invention in a practical phase. Further, various aspects of the invention can be provided by appropriately combining two or more of the constituents disclosed in the above embodiments.

For example, some of the constituents out of all the constituents in the above embodiments and modifications may be combined or deleted. Furthermore, constituents according to another embodiment may be used in combination as appropriate.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

The invention claimed is:

1. An image formation unit comprising:

a developer storage configured to store developer;

an image carrier on which an electrostatic latent image is formed;

a developer carrier facing the image carrier and configured to transfer developer to the electrostatic latent image;

a developer housing portion located below the developer storage and configured to house the developer from the developer storage;

a supply port configured to supply the developer in the developer storage into the developer housing portion;

a developer amount detection member rotatably disposed in the developer housing portion at a position below the supply port; and protrusions disposed on the developer amount detection member, wherein, with respect to an axial direction of the developer amount detection member, an interval between each adjacent protrusions is greater at end portions of the developer amount detection member than at a center portion of the developer amount detection member.

2. The image formation unit according to claim 1, wherein the protrusions work in conjunction with one another to spread the developer supplied through the supply port in a longitudinal direction of the developer amount detection member.

3. The image formation unit according to claim 1, wherein the protrusions are arranged in parallel with one another on a flat plate which is provided to extend in a direction of a rotational axis of the developer amount detection member and to protrude in a radial direction.

4. The image formation unit according to claim 3, wherein the flat plate of the developer amount detection member has:

a leading surface in a direction of rotation of the developer amount detection member; and a trailing surface in the direction of rotation of the developer amount detection member, the trailing surface being opposed to the leading surface, and the protrusions are arranged on the trailing surface of the flat plate.

5. The image formation unit according to claim 4, wherein each of the protrusions is disposed to be inclined in such a manner as to extend in a radial direction of the rotation axis of the developer amount detection member from the rotation axis and in a direction from an end portion of the flat plate toward the supply port.

6. The image formation unit according to claim 1, wherein an interval between each adjacent protrusions increases away from the supply port.

7. The image formation unit according to claim 1, wherein the developer amount detection member has a smooth surface on a leading surface relative to a direction of rotation of the development amount detection member, and the protrusions are provided on a surface opposed to the smooth surface.

8. The image formation unit according to claim 1, wherein the developer amount detection member rotates to convey the developer in a direction where the developer amount detection member extends.

9. The image formation unit according to claim 8, wherein the developer amount detection member conveys the developer in a direction away from the supply port.

10. An image formation apparatus comprising at least one image formation unit according to claim 1.

11. An image formation unit comprising:

a developer storage configured to store developer;

an image carrier on which an electrostatic latent image is formed;

a developer carrier facing the image carrier and configured to transfer developer to the electrostatic latent image;

a developer housing portion located below the developer storage and configured to house the developer from the developer storage;

a supply port configured to supply the developer in the developer storage into the developer housing portion;

a developer amount detection member rotatably disposed in the developer housing portion at a position below the supply port; and protrusions disposed on the developer amount detection member, wherein the developer amount detection member is rotatable to convey the developer in a direction where the developer amount detection member extends, wherein the protrusions are arranged in parallel with one another on a flat plate and extend from a radial end portion of the flat plate, wherein the protrusions are inclined in such a manner as to radially extend toward the rotational axis of the developer amount detection member and extend from a center area toward an end of the developer amount detection member in the axial direction.

12. The image formation unit according to claim 11, wherein the developer amount detection member is configured to convey the developer in a direction away from the supply port.

13. The image formation unit according to claim 12, wherein the developer amount detection member has:

a conveyance portion configured to convey the developer; and a developer reception portion configured to receive pressure from accumulated developer.

14. An image formation apparatus comprising at least one image formation unit according to claim 11.

15. The image formation unit according to claim 11, wherein the flat plate of the developer amount detection member affects a center of gravity of the developer amount detection member such that, after the flat plate passes a top point of the rotation of the developer amount detection member in the rotational direction, the developer amount detection member rotates due to its own weight.

16. The image formation unit according to claim 15, wherein the flat plate extends radically outward from a remaining portion of the developer amount detection member.

17. The image formation unit according to claim 11, wherein the protrusions are inclined at an angle $\alpha$, wherein $0<\alpha<90°$.

18. An image formation unit comprising:

a developer storage configured to store developer;

an image carrier on which an electrostatic latent image is formed;

a developer carrier facing the image carrier and configured to transfer developer to the electrostatic latent image;

a developer housing portion located below the developer storage and configured to house the developer from the developer storage;

a supply port configured to supply the developer in the developer storage into the developer housing portion;

a rotation member rotatably disposed in the developer housing portion at a position below the supply port, wherein the rotation member is rotatable to convey the developer in a direction where the rotation member extends, wherein the rotation member is formed with a flat plate radially extending with respect to a rotational axis of the rotation member; and protrusions arranged substantially parallel with one another and extending from a radial end portion of the flat plate, wherein the protrusions are inclined in such a manner as to face a center portion of the rotation member in the axial direction of the rotation member, such that a first subset of the protrusions on a first portion of the flat plate are inclined in a first direction with respect to the flat plate and such that a second subset of the protrusions on a second portion of the flat plate are inclined in a second direction with respect to the flat plate, the first direction being different from the second direction.

19. The image formation unit according to claim 18, wherein the flat plate of the rotation member affects a center of gravity of the rotation member such that, after the flat plate passes a top point of the rotation of the rotation member in the rotational direction, the rotation member rotates due to its own weight.

20. The image formation unit according to claim 18, wherein the protrusions are inclined at an angle $\alpha$, wherein $0<\alpha<90°$.

* * * * *